US011351442B1

(12) United States Patent
Pickens

(10) Patent No.: US 11,351,442 B1
(45) Date of Patent: Jun. 7, 2022

(54) MAGNETIC CARD HOLDER ASSEMBLY

(71) Applicant: Jeffrey John Pickens, Dublin, CA (US)

(72) Inventor: Jeffrey John Pickens, Dublin, CA (US)

( * ) Notice: Subject to any disclaimer, the term of this patent is extended or adjusted under 35 U.S.C. 154(b) by 271 days.

(21) Appl. No.: 16/536,282

(22) Filed: Aug. 8, 2019

Related U.S. Application Data

(60) Provisional application No. 62/716,904, filed on Aug. 9, 2018.

(51) Int. Cl.
*A63F 1/10* (2006.01)
*A63F 1/06* (2006.01)

(52) U.S. Cl.
CPC ..... *A63F 1/10* (2013.01); *A63F 1/062* (2013.01); *A63F 1/067* (2013.01)

(58) Field of Classification Search
CPC .. A63F 1/10; A63F 1/062; A63F 1/067; A63F 3/00694; A63F 7/0088; A63F 9/34; A63F 2003/00545; A63F 2003/0063; A63F 2003/00738; A63F 2003/00927; A63F 2007/405; A63F 2009/1212; A63F 2009/2413; A63F 2009/248; A63F 2003/00391; A63F 2007/4056; A63F 2009/1033
USPC ..... 40/124.191; 273/284
See application file for complete search history.

(56) References Cited

U.S. PATENT DOCUMENTS 2,095,482 A * 10/1937 Spicciato ..... A47B 3/0912 273/284
3,210,080 A * 10/1965 Rael ..... A63F 3/00694 273/309
4,811,954 A * 3/1989 Hemmann ..... A63F 3/0023 273/284
4,865,325 A * 9/1989 Stolz ..... A63F 9/1044 273/157 R
5,478,085 A * 12/1995 Canner ..... A63F 3/00694 273/239
5,727,787 A * 3/1998 Salley ..... A63F 3/00895 273/287
8,863,672 B1 * 10/2014 Silknitter ..... A47B 23/06 108/38
9,044,688 B1 * 6/2015 Janay ..... A63H 33/04
10,478,710 B1 * 11/2019 Paul ..... H01F 7/02
2005/0017449 A1 * 1/2005 Belcher ..... A63F 3/00075 273/287

* cited by examiner

*Primary Examiner* — Michael D Dennis
(74) *Attorney, Agent, or Firm* — Adibi IP Group, PC; Amir V. Adibi; Andrew C. Palmer

(57) ABSTRACT

A magnetic card holder assembly that forms a card playing surface that allows users to play card games in environments with high winds or other disruptive elements. The magnetic card holder assembly comprises a main unit, a plurality of card holder slabs, and a plurality of deck protector sleeves. The card holder comprises the main unit and slabs that can be stacked in closed configuration for storage or connected in an open configuration for game playing. Each slab has a plurality of magnets. Each of the deck protector sleeves includes a deck magnet that is attracted to the slab magnets. In operation, playing cards are inserted into the magnetized deck protectors. The magnetized deck protectors that contain the cards are placed and retained on the upper surface of the magnetized slabs. The magnetic card holder is transportable where game play can be paused without concern about disruption of game play.

17 Claims, 12 Drawing Sheets

TOP PERSPECTIVE VIEW OF A MAGNETIC CARD HOLDER ASSEMLY

TOP PERSPECTIVE VIEW OF A MAGNETIC CARD HOLDER ASSEMLY

MAGNETIC RECEPTIVE INSERT, DECK OF CARDS, AND DECK PROTECTOR SLEEVE

PLACEMENT OF MAGNETIC RECEPTIVE INSERT WITH DECK OF CARDS PRIOR TO PLACEMENT WITHIN PROTECTOR SLEEVE

DECK PROTECTOR SLEEVE CONTAINING MAGNETIC RECEPTIVE INSERT AND DECK OF CARDS

TOP PERSPECTIVE VIEW OF MAGNETIC CARD HOLDER SLAB

TOP PERSPECTIVE VIEW OF A MAGNETIC CARD HOLDER CLOSED CONFIGURATION

TOP PERSPECTIVE VIEW OF MAGNETIC CARD HOLDER WITH TOP TWO SLABS REMOVED DURING TRANSITION FROM CLOSED TO OPEN CONFIGURATION

TOP PERSPECTIVE VIEW OF MAGNETIC CARD HOLDER WITH ALL THREE SLABS REMOVED DURING TRANSITION FROM CLOSED TO OPEN CONFIGURATION

TOP VIEW OF MAGNETIC CARD HOLDER WITH ALL PIECES ALIGNED IN OPEN CONFIGURATION (DISENGAGED)

TOP VIEW OF MAGNETIC CARD HOLDER WITH ALL PIECES CONNECTED BUT NOT LOCKED IN OPEN CONFIGURATION

TOP VIEW OF MAGNETIC CARD HOLDER WITH ALL PIECES CONNECTED AND LOCKED IN OPEN CONFIGURATION

PACKAGED MAGNETIC CARD HOLDER ASSEMBLY

AMOUNT OF INSTRUCTIONS

MAGNETIC CARD HOLDER ASSEMBLY

CROSS-REFERENCE TO RELATED APPLICATIONS

This application claims the benefit under 35 U.S.C. § 119 of U.S. provisional patent application Ser. No. 62/716,904, entitled "Magnetic Card Holder Assembly," filed on Aug. 9, 2018. The subject matter of U.S. provisional patent application Ser. No. 62/716,904 is incorporated herein by reference.

TECHNICAL FIELD

The described embodiments relate to magnetic surfaces, and more particularly magnetic card holders that operate as magnetized playing surfaces for magnetized deck-protectors.

BACKGROUND INFORMATION

Despite the trend of gaming being developed in the digital age, there is still high demand of playing with physical cards because of its charm and practicality. There are various types of cards including: playing cards, sports cards, and other collectible cards. These cards may be traded amongst collectors, but there are countless games that can be played with these cards as well. Most games require a stable playing field. This is because the configuration of the cards on the playing field is imperative to the gameplay. To play certain games, users are restricted to areas with large playing surfaces and of low wind as to prevent the cards from being disturbed during gameplay. As such, users are unable to play games if there is any wind that can affect the playing field or any turbulence such as when traveling in a vehicle or when players move around and accidentally bump the playing field.

Currently, users are required to manually hold down the cards, or use a tray with edges to keep cards from sliding off the playing surface. However, a short-fall in this approach is that it does not prevent the cards from being disrupted by wind or turbulence from a mobile vehicle or other accidental external force. In addition, when playing in a confined area, users must often place cards overlapping each other, and as a result, the slippery surface of each playing card also adds to the cards being affected by the turbulence. Another solution is to use a playing field such as felt to increase the friction between the playing surface and the playing card. A shortcoming with this solution is that the cards are still affected by wind or turbulence.

In addition, game play is often interrupted due to external factors. Currently there is no way to stop game play effectively without affecting the position or orientation of cards. A solution that overcomes these shortcomings is desired.

SUMMARY

A magnetic card holder assembly comprises a magnetic card holder and a corresponding magnetic receptive deck protector sleeve. The magnetic card holder forms a card playing surface that allows users to play card games in environments with high winds or other disruptive elements. The magnetic card holder comprises a first card holder slab, a second card holder slab, a third card holder slab, and a main unit. The main unit stores the slabs, cards and other game items. The magnetic receptive deck protector sleeve includes a deck protector sleeve with at least one magnetic receptive insert inserted into the sleeve. One or more playing cards are insertable into the magnetic receptive deck protector sleeve. In one example, the magnetic receptive insert is a magnet having a card-shape that fits inside the sleeve.

Each of the first, second and third card holder slabs has a plurality of magnets embedded into the upper surface. In operation, the magnetized slabs attract and retain the magnetized deck protector sleeves. One or more cards are inserted into the magnetized deck protectors. The magnetized deck protectors containing the cards are then placed and magnetically retained on the upper surface of a card holder slab.

The card holder assembly has two modes of configuration. The first mode is a closed configuration or compact mode that is employed to store and transport the magnetic card holder. In operation, a user places the magnetic card holder assembly into the closed configuration by stacking each slab into the main unit. Each slab has hooks protruding from one side that fits into a corresponding space on the main unit.

The second mode is an open configuration or operational mode where cards contained within the magnetized deck protector sleeves can be placed on the slabs for game play. The slabs provide a gaming field for the game to proceed. Because of the strong magnetic attraction between the cards and the gaming field, the magnetic card holder assembly is transportable and game play can be paused without concern about disruption of the positions of the cards.

To set up the assembly for game play, a user must transition the card holder from closed to open configuration. The open configuration is achieved by first removing the slabs from the main unit, then attaching a first slab via its horizontal surface to the horizontal surface of the main unit such that the upper surface is facing upwards. The connection is achieved by hooks on the slab and hook receivers on the main unit. The slab facing side of the main unit has indentations that are shaped to function as hook receivers. On one horizontal side of each slab, there are hook protrusions. On the other horizontal side of each slab, there are indentations that are shaped to function as hook receivers. A second slab's hooks are connected to the first slab's hook receivers via the horizontal surface of both slabs. The last third slab is attached to the second slab in a similar fashion. The slabs may be attached in different orders as those set forth above.

The user has the option to use each magnetic card holder slab separately or in conjunction with the other magnetic card holder slabs depending on the desired gaming field size. A user may attach more slabs via the horizontal hooks and corresponding hook receivers in order to extend the gaming field in the open configuration. Once the magnetic card holder assembly is in its open configuration, the user may now play cards on the upper surface.

In a method of fabrication, three magnetic card holder slabs are formed. In one example, the slabs are formed using an injection molding process. On the upper portion of each slab are a plurality of indentations dedicated to holding a plurality of magnets. Next, magnets are embedded into the indentations; one magnet to one indentation. In other methods of fabrication, the magnets are attached in different orders as those set forth above.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
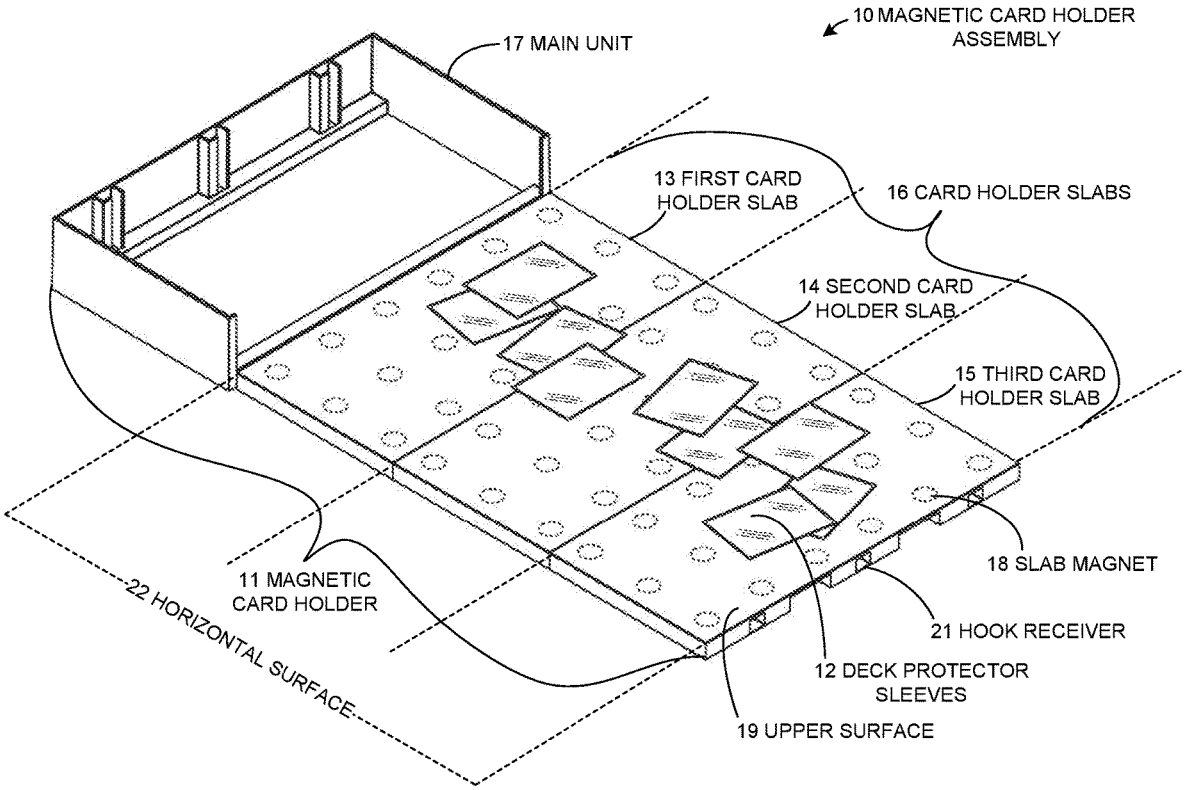
FIG. 1 is a top perspective view of a magnetic card holder assembly 10 in an open configuration.

FIG. 1 is a top perspective view of a magnetic card holder assembly 10 in an open-configuration. The assembly comprises the magnetic card holder 11 and the magnetic deck protector sleeves 12. In this example, the magnetic card holder 11 has four separable portions: a first card holder slab 13, a second card holder slab 14, a third card holder slab 15, and a main unit 17. The slabs 16 are identical to each other and has a plurality of slab magnets 18 embedded in the upper surface 19 of each slab. Each slab has a hook 20 and hook receiver 21 on its horizontal side surface 22, which allows each slab to connect to each other and to the main unit 17 during open configuration. While in open configuration, players may now play cards by placing on the upper surface of the slabs 19, the magnetized deck protector sleeves 12 that contain playing cards. The magnetic receptive insert 25 in the sleeve 12 are attracted to slab magnets 18 on the slabs 16 such that unintended movement of the cards 26 (visible in FIG. 2A) contained in the sleeve 12 are prevented upon placement.

In this example, the card holder slab magnets 18 are embedded into the upper surface 19 of the card holder slabs 16. In another example, the magnets 18 are attached using a glue adhesive. In other examples, the card holder slab magnets 18 are attached by other adhesives. Also, in this example, the card holder slab magnets 18 comprise flexible magnets made of Neodymium Iron-Boron (NdFeB). In another example, the magnets 18 may be made of another magnetic material such as: Cobalt, Aluminum, Magnetite, Nickel, Manganese or Iron. In yet another example, the embedded magnets 18 are made of Neodymium Iron-Boron (NdFeB) with the strength of N35. In another example, the strength of the magnets may be stronger or weaker. In other embodiments, the magnets 18 have varying strengths based on the size and dimensions.

In FIG. 1, the dimensions of each of the slabs 16 consists of four sides and a height 23 ranging from 1 centimeter to 5 centimters. The main unit 17 has a height 24 equal or more than the combined height of all three slabs 16. In another example, the number of card holder slabs 16 may be more or less than three (3). In such an example, the height of the main unit 16 may be adjusted to correspond to a height equal or more than the combined height of the slabs 16 that may be more or less than three.

Figures 2A, 2B, 2C:
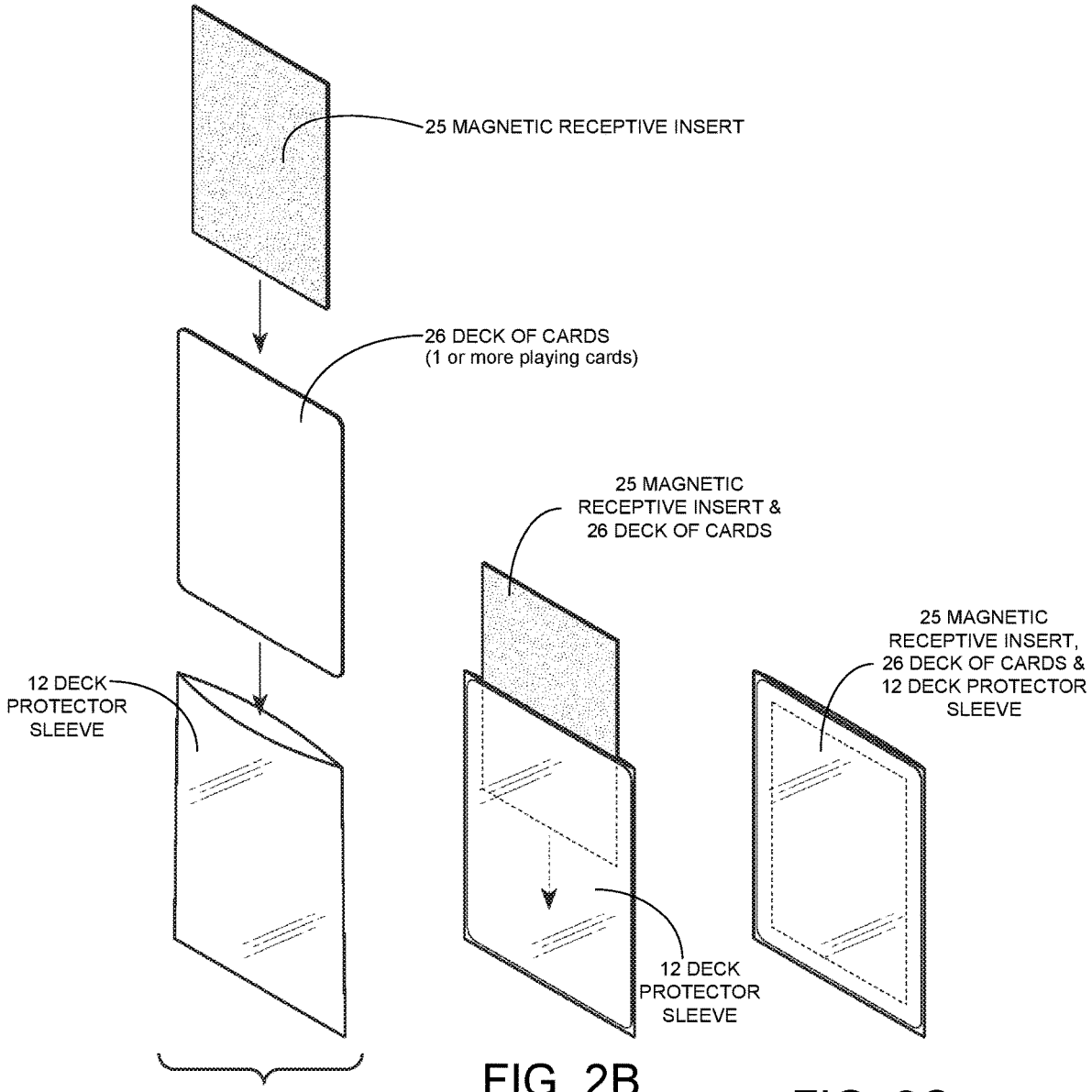
FIG. 2A illustrates the magnetic receptive insert, one or more playing cards, and a deck protector sleeve.
FIG. 2B illustrates the placement of the magnetic receptive insert with the deck of cards prior to placement within the deck protector sleeve.
FIG. 2C illustrates the deck protector sleeve holding the magnetic receptive insert and the deck of cards.

FIGS. 2A-C illustrates the process of inserting a magnetic receptive insert 25 and a deck of cards 26 (one or more playing cards) into a deck protector sleeve 12. FIG. 2A illustrates the magnetic receptive insert 25 and deck of cards 26, and deck protector sleeve 12 in loose configurations with arrows indicating that the magnetic receptive insert 25 is to be placed with the cards 26 to be inserted in the sleeve 12. FIG. 2B illustrates the placement of the combined magnetic receptive insert 25 with cards 26 partially placed within the deck protector sleeve 12. FIG. 2C illustrates the deck protector sleeve 12 that contains the magnetic receptive insert 25 with the deck of cards 26.

At least one surface of the deck protector sleeve 12 is transparent such that a surface of a playing card of the deck 26 is visible when inside the deck protector sleeve 12. In this example, a user places a flexible iron magnet behind a card or deck of cards 26 and inserts both of cards 26 and magnet 25 into a deck protector sleeve 12. In another example, the magnetic receptive inserts 25 are attached to the sleeve 12 using a glue adhesive. In other examples, magnetic receptive inserts 25 are attached by other adhesives.

In this example, the magnetic receptive inserts 25 comprise of flexible magnet made of Neodymium Iron-Boron (NdFeB). In another example, the magnetic receptive inserts 25 may be made of another magnetic material such as: Cobalt, Aluminum, Magnetite, Nickel, Manganese, or Iron. In other embodiments, the magnets 25 have varying strengths based on the size and dimensions of the deck protector sleeve 12. In yet another example, the magnets 25 are made of Neodymium Iron-Boron (NdFeB) with the strength of N35. In another example, the strength of the magnets 25 may be stronger or weaker. In other embodiments, the magnets 25 have varying strengths based on its size and dimensions.

Figure 3:
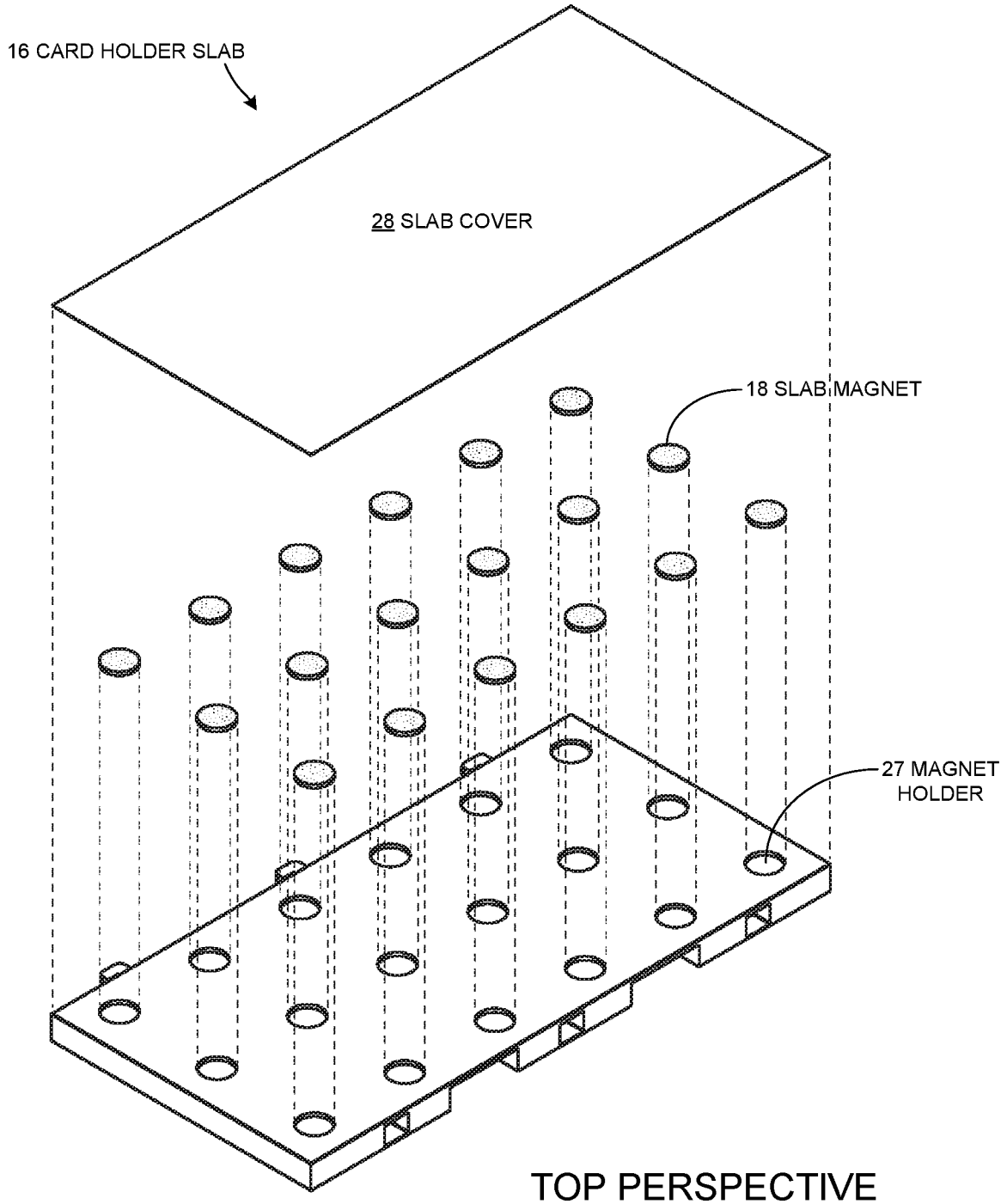
FIG. 3 is a top perspective view of one of the magnetic card holder slabs.

FIG. 3 is a top perspective view of one of the magnetic card holder slabs 16. On the upper surface 19 of the card holder slabs 16 are embedded magnets 18 that attracts and retains the deck protectors sleeves 12 that contain the deck of cards 26. The upper surface 19 of each card holder slab contains indentations for holding magnets 27. Each magnet holder 27 corresponds to a magnet 18 to be embedded into the magnet holder 27. In accordance with one novel aspect, the magnetic receptive insert 25 has the strength to prevent the deck 26 from becoming separated from the magnetic card holder slabs 16 even when flipped upside down. In accordance with one novel aspect, the magnetic card holder assembly 10 provides active game play during disruptive conditions (for example, environmental wind, turbulence in an aircraft, vehicle, or water vessel, or household pets). In addition, the magnetic characteristics permit game play to resume after pausing game play.

In this example, the embedded card holder slab magnets 18 may be made of Neodymium Iron Boron (NdFeB). In another example, the magnets 18 may be made of other magnetic material such as: Cobalt, Aluminum, Magnetite, Nickel, Manganese, or Iron. In this example, the slabs 16 and main unit 17 may be made from injection molded plastic forms. In another example, the slabs 16 and main unit 17 may be made from other stable material including but not limited to metal, other plastics, rubber, wood or glass.

In FIG. 3, each slab 16 also comprises a cover 28 that covers the top of the upper surface 19 that will cover the appearance of the magnets 18. In this example, the cover 28 has a layer of UV coated artwork that is split into three (3) pieces to correspond to the first, second, and third card holder slabs 13, 14 and 15 in FIG. 1, such that when all three slabs 13, 14 and 15 are connected in proper sequence, the user will see the full artwork. In another example, the art cover 28 may be independent artwork for each slab.

Although the magnetic card holder is shown as having four separate portions of three slabs 16 and a main unit 17, in other examples, the magnetic card holder has three portions that are separable and are attached by a hinge that allows the magnetic card holder to fold into the closed and open configurations. In yet another example, the magnetic card holder is a unitary structure that is always in the open-configuration.

Figure 4A:
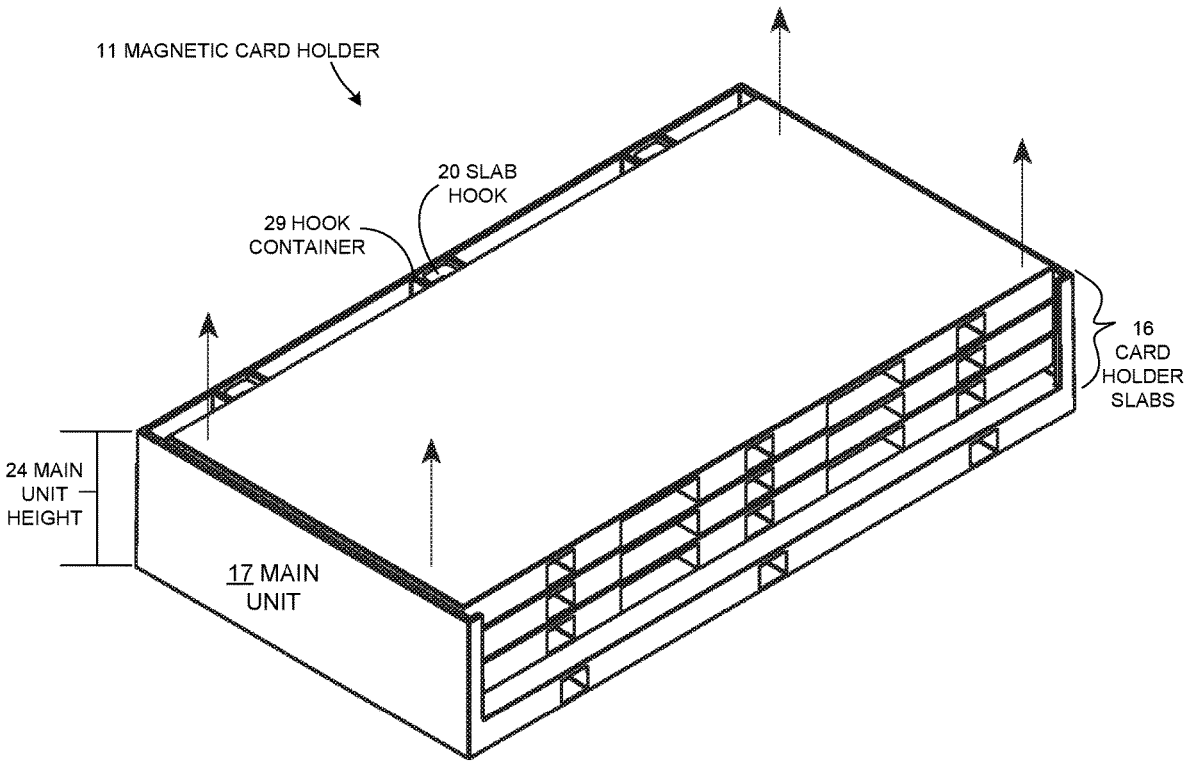
FIG. 4A is a top perspective view of a magnetic card holder 11 in an closed configuration.
Figure 4B:
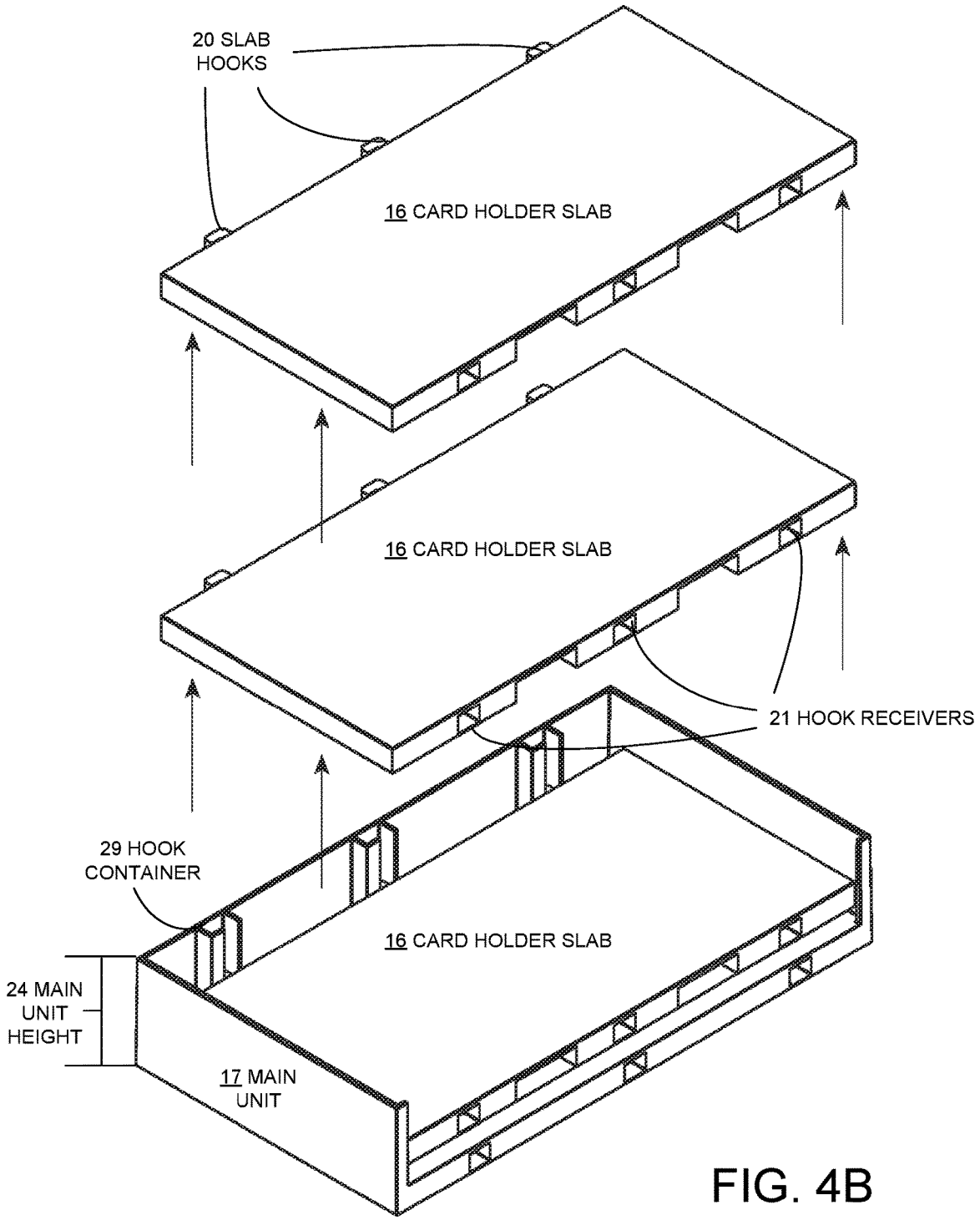
FIG. 4B is a top perspective view of a magnetic card holder 11 with the top two slabs removed during the transition from closed configuration to open configuration.
Figure 4C:
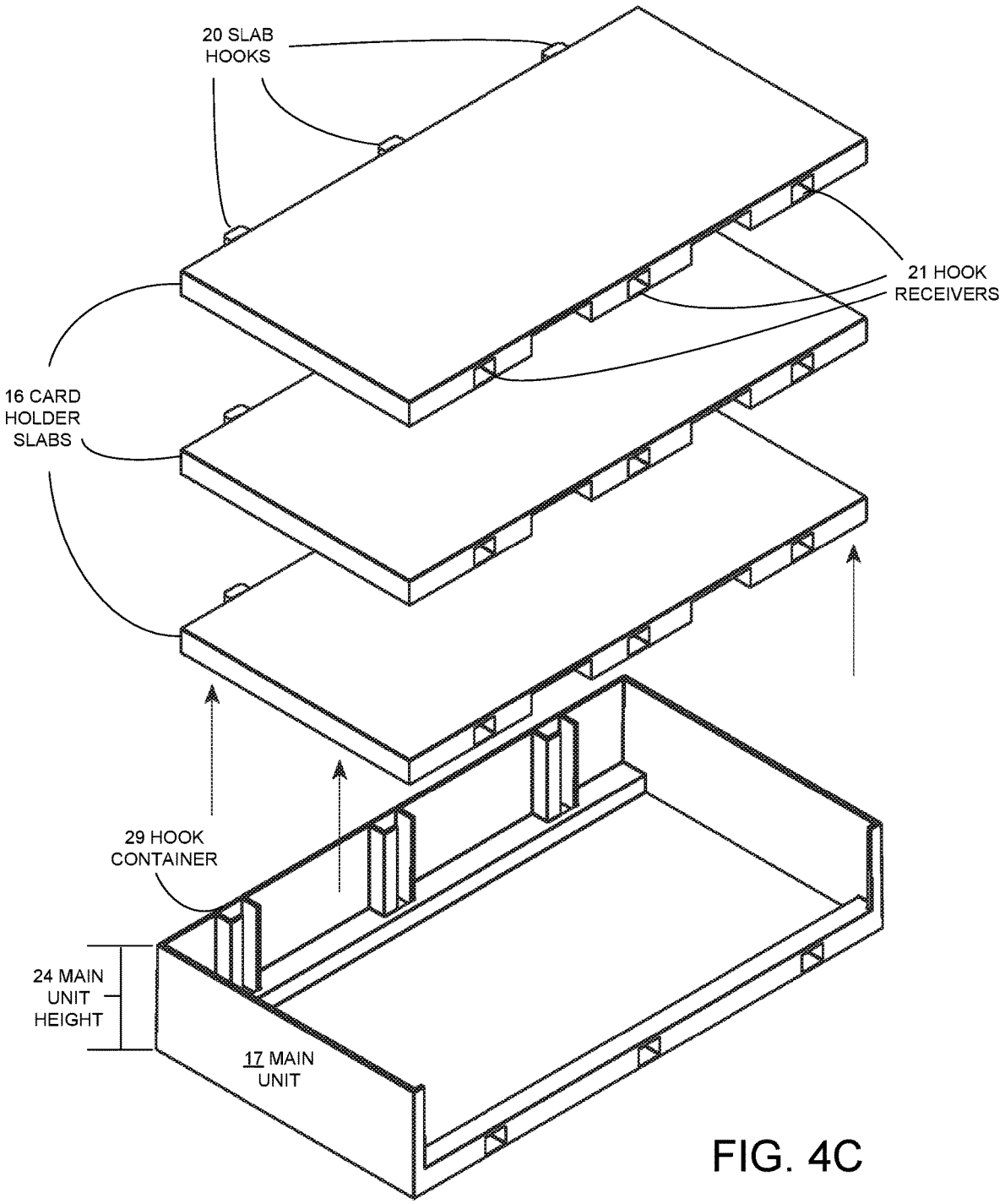
FIG. 4C is a top perspective view of a magnetic card holder 11 with the all three slabs removed during the transition from closed configuration to open configuration.

FIGS. 4A-C illustrates the process of transitioning the card holder from closed to open configuration. FIG. 4A is a top perspective view of a magnetic card holder 11 in a closed configuration. In this example, the closed configuration allows a user to easily transport the entire assembly as well as store cards and other gaming material. The slabs 16 are stacked on top of each other inside the main unit 17. The main unit 17 has a structure that allows the protruding slab hooks 20 to slide into its hook container 29. In this example, the main unit 17 has a height 24 that is greater than the combined height of the slabs 16.

FIG. 4B is a top perspective view of a magnetic card holder 11 with the top two slabs removed during the transition from closed configuration to open configuration. In this example, the user can easily transition the card holder 11 from closed configuration to open configuration by first removing the card holder slabs 16 vertically and perpendicularly away from the main unit 17. By removing the slabs 16 upward, the slab hooks 20 slides out of the main unit's hook container 29.

FIG. 4C is a top perspective view of a magnetic card holder 11 with the all three slabs 16 removed from the main unit 17 during the transition from closed configuration to open configuration. In this example, the user can transition the holder 11 from closed configuration to open configuration by first vertically removing each of the three card holder slabs 16.

Figure 5A:
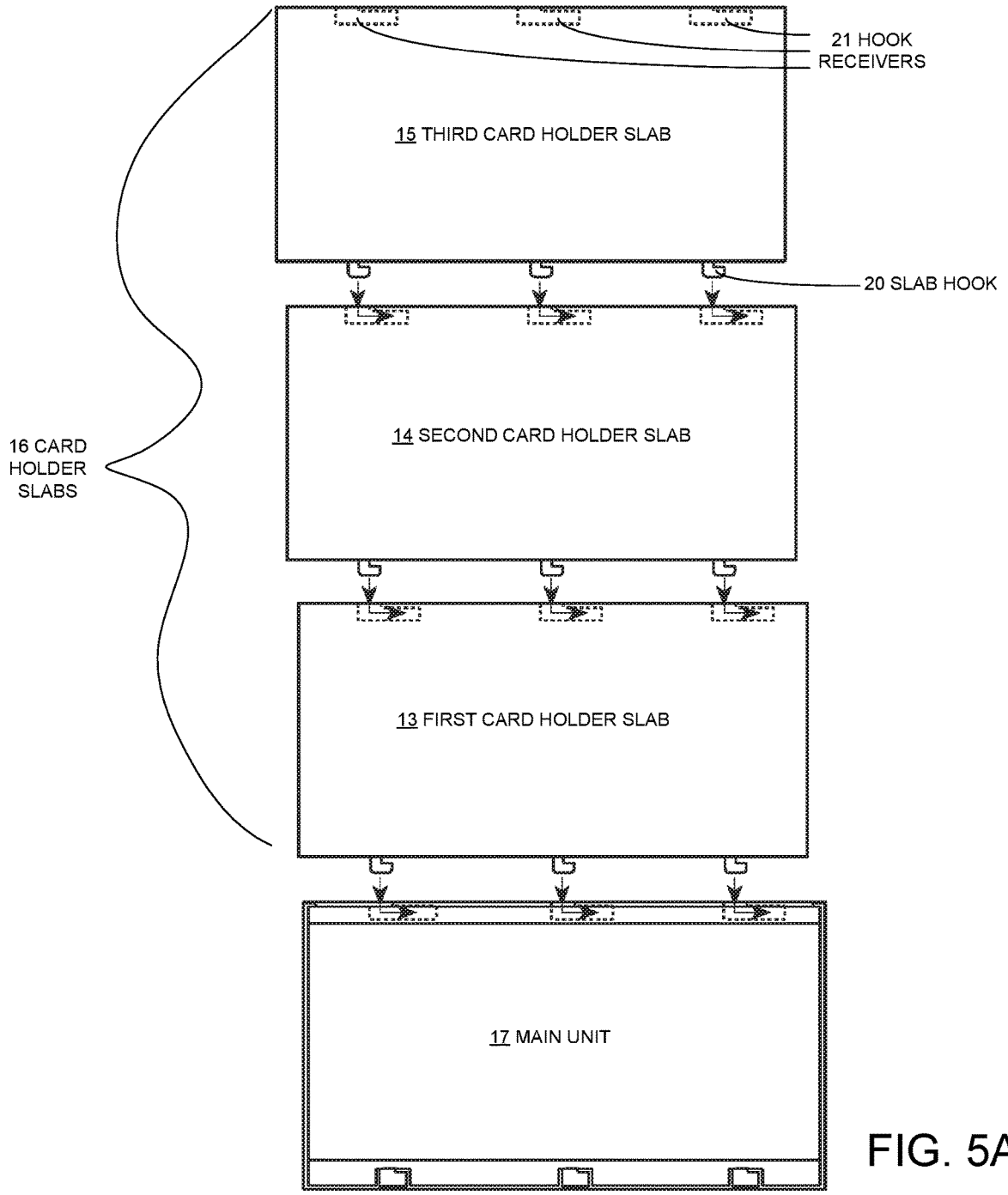
FIG. 5A is a top view of the magnetic card holder 11 with all pieces aligned in the open configuration but disengaged.
Figure 5B:
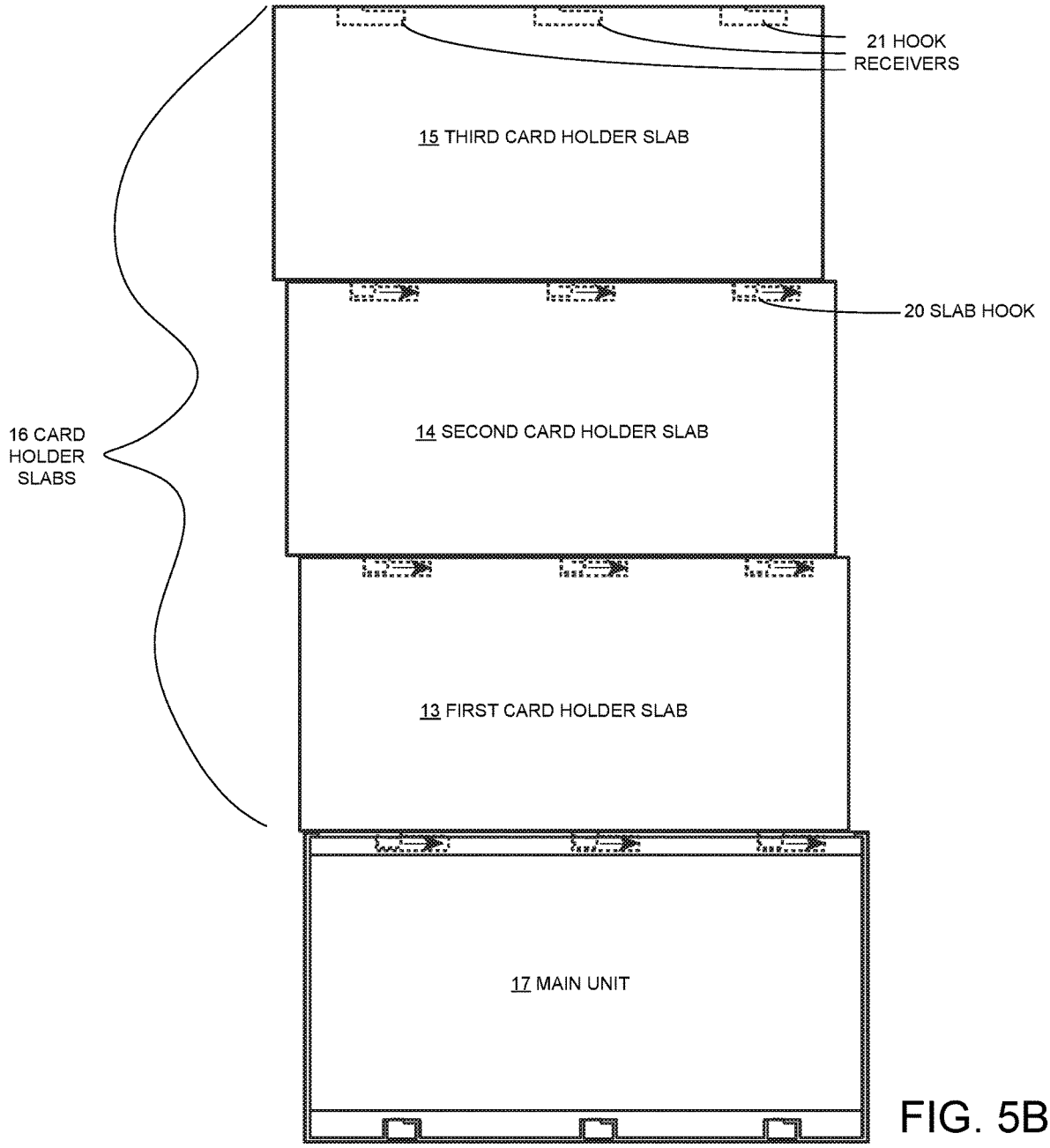
FIG. 5B is a top view of the magnetic card holder 11 with all pieces connected in the open configuration but not in lock position.
Figure 5C:
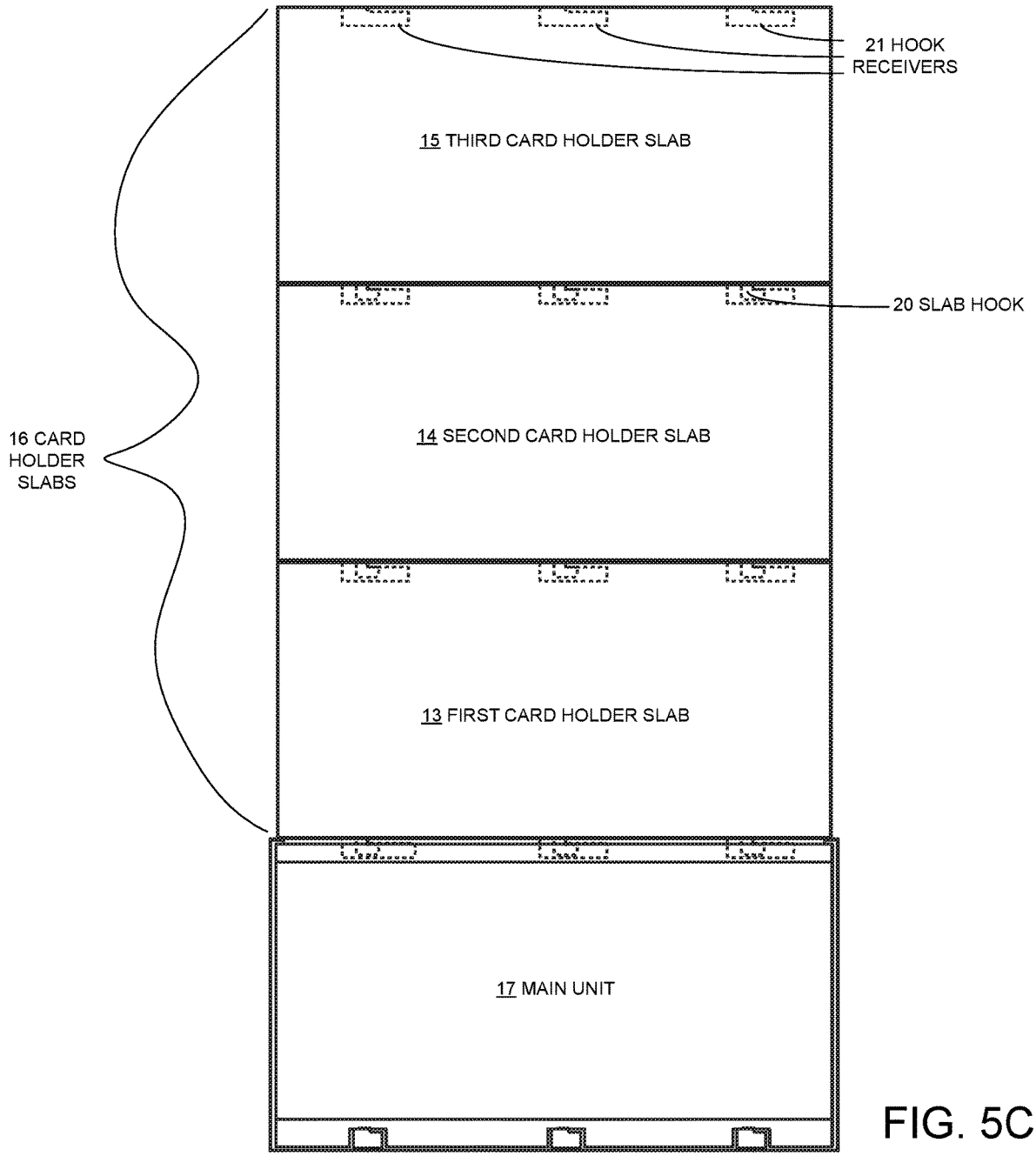
FIG. 5C is a top view of the magnetic card holder 11 with all pieces connected and locked in the open configuration.

FIGS. 5A-C illustrates the process of connecting the three card holder slabs 13, 14 and 15 to the main unit 17 together in the open configuration. FIG. 5A is a top view of the magnetic card holder 11 with all pieces aligned in the open configuration but disengaged. In this example, there are three hooks 20 protruding from a side of each card holder slab 16 along the horizontal side surface 22. On the opposite side of each card holder slab 16, there are three corresponding horizontal hook receivers 21. The main unit 17 also contains three horizontal hook receivers 21 on the open end of the main unit 17. In another example, the magnetic card holder 11 may have more or less hooks 20 and hook receivers 21. In yet another example, each of the card holder slabs 16 has one and only one hook 20 and a corresponding hook receiver 21 used to configure the magnetic card holder in the open configuration.

In this example, the first card holder slab 13 is placed so that the side having the protruding hooks 20 is aligned with the hook receiver 21 of the main unit 17. The second card holder slab 14 is placed so that the side having the protruding hooks 20 is aligned with the hook receiver 21 of the first card holder slab 13. The third card holder slab 15 is placed so that the side having the protruding hooks 20 is aligned with the hook receiver 21 of the second card holder slab 14. Any of the slabs 16 is attachable to the main unit 17. The slabs 16 may be connected to the main unit 17 in any order desired by the user. The designations of first, second and third card holder slabs are arbitrary and utilized to assist in the illustrations.

FIG. 5B is a top view of the magnetic card holder 11 with all pieces connected in the open configuration but not in the lock position. In this example, the card holder slabs are secured together by sliding such that the hooks 20 engage the receivers 21. In another example, the locking mechanism may be activated with a latch or release button. FIG. 5C is a top view of the magnetic card holder 11 with all pieces connected and locked in the open configuration. FIG. 5C illustrates the final configuration for playing of a card game such that players may now play cards on the upper surface 19 of the card holder 11. The first card holder slab 13, the second card holder slab 14 and the third card holder slab 15 are aligned and form a rectangular card playing surface.

Figure 6:
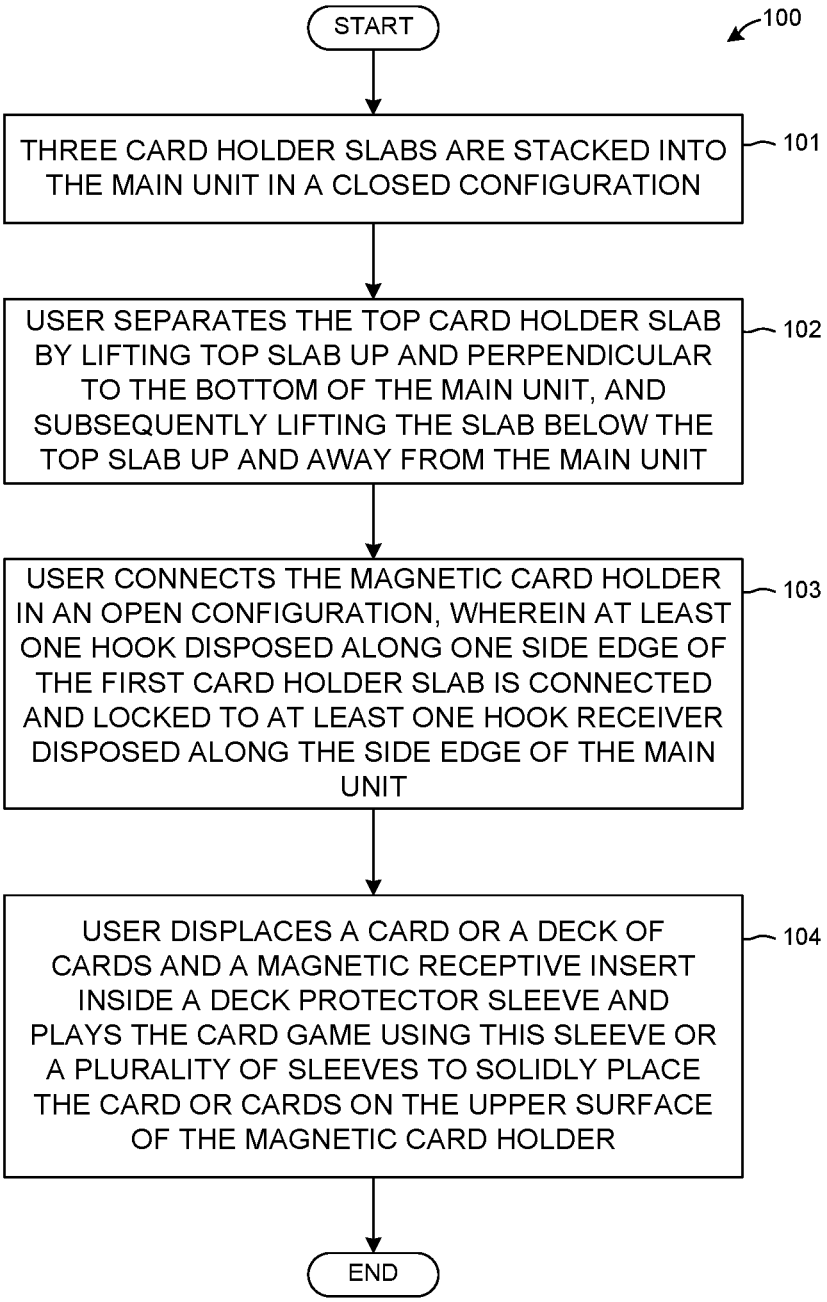
FIG. 6 is a flowchart of a method 100 in accordance with one novel aspect.

FIG. 6 is a flowchart of a method 100 in accordance with one novel aspect. In a first step (step 101), three card holder slabs are stacked into the main unit in a closed configuration. For example, in FIG. 4A, all three card holder slabs 16 are stacked into the main unit 17 by aligning the horizontal hooks 20 that protrude from the horizontal side surface 22 of the slabs 16 into the designated hook holders of the main unit 17.

In a second step (step 102), a user separates the top card holder slab by lifting the top slab up and perpendicular to the bottom of the main unit, and subsequently lifting the slab below the top slab up and away from the main unit. For example, in FIGS. 4B and 4C, a user would lift each slab 16 vertically and perpendicularly away from the bottom of the main unit 17, until each of the slabs 16 has been removed from the main unit 17.

In a third step (step 103), a user connects the magnetic card holder 11 in an open configuration, wherein at least one hook 20 disposed along one side edge of the first card holder slab 13 is connected and locked to at least one hook receiver 21 disposed along the side edge of the main unit 17. For example, in FIG. 5A, the card holder slabs are being connected by aligning the horizontal hooks of the first card holder slab to the horizontal hook receivers of the second card holder slab. As seen in the example in FIGS. 5A, 5B and 5C, after the at least one hook 20 and hook receiver 21 are aligned, the hook 20 must then be inserted and moved to a locked position.

In a fourth step (step 104), a user displaces a card or a deck of cards 26 and a magnetic receptive insert 25 inside a deck protector sleeve 12 and plays the card game using this sleeve 12 or a plurality of sleeves 12 to securely place the card or cards on the upper surface 19 of the magnetic card holder 11.

Figure 7:
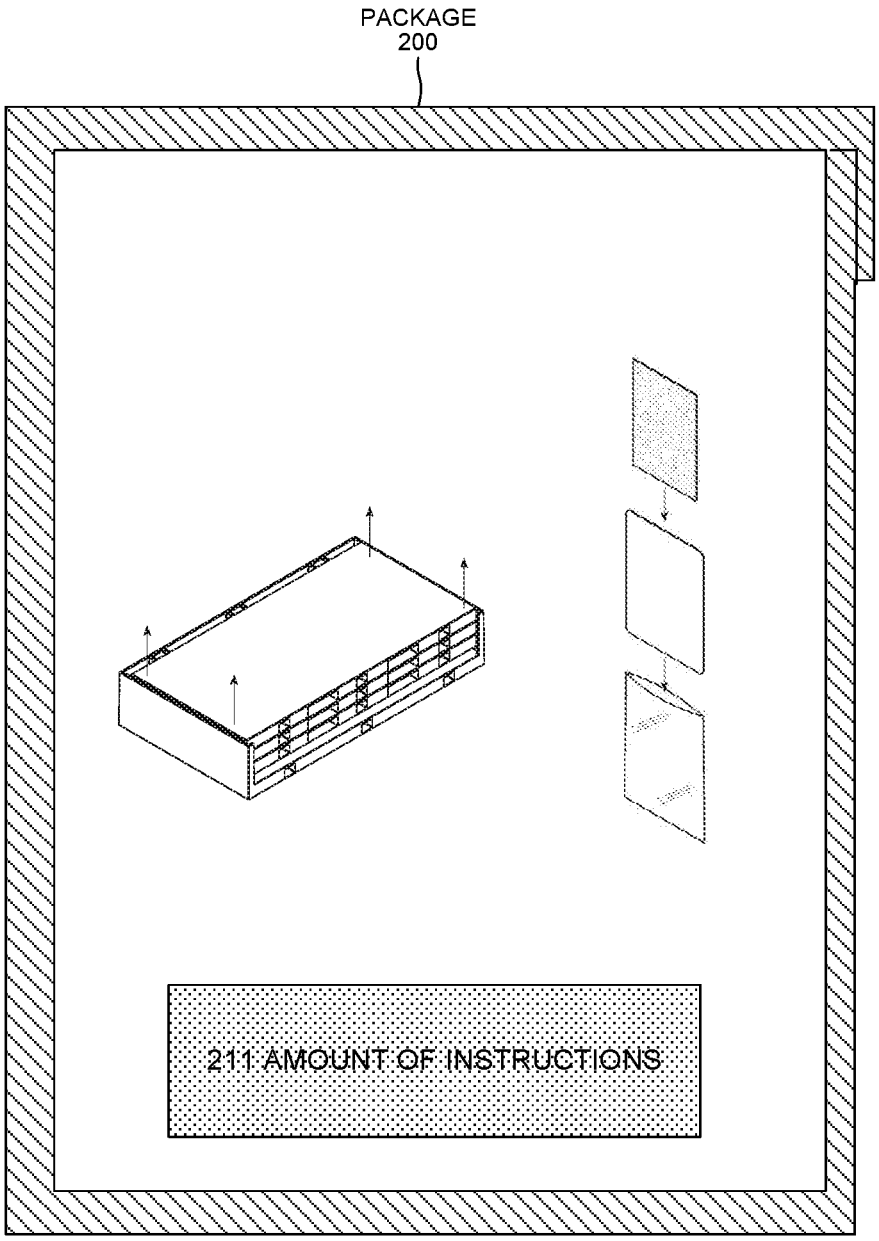
FIG. 7 illustrates the packaged magnetic card holder assembly.

FIG. 7 illustrates a package 200 of the magnetic card holder assembly 10, which includes an amount of instructions 211.

Figure 8:
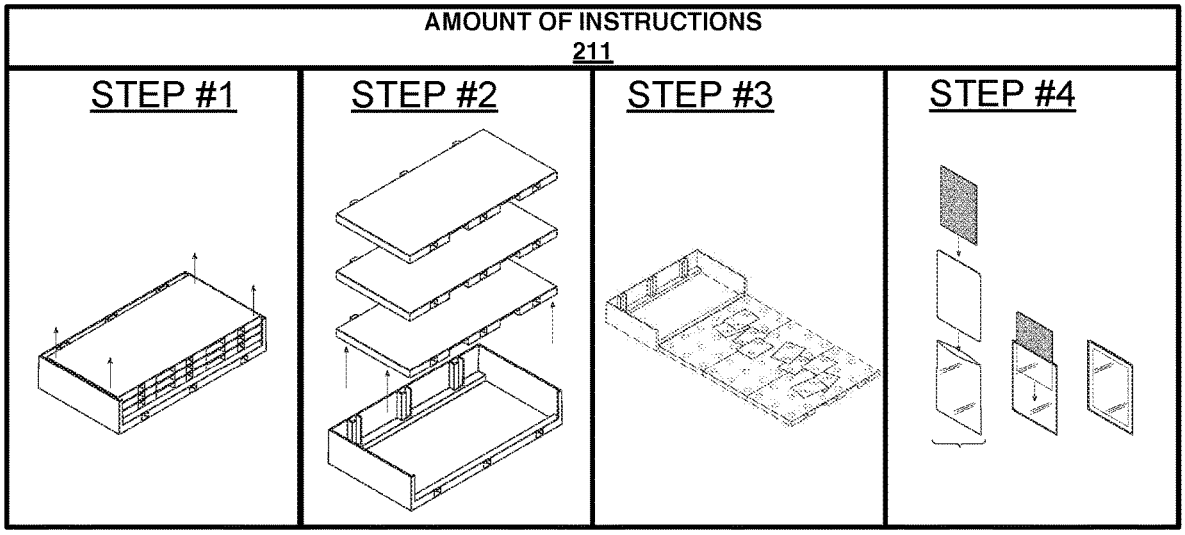
FIG. 8 illustrates an amount of instructions.

FIG. 8 illustrates the amount of instructions 211 illustrating the four steps of putting together the magnetic card holder assembly 10 that are included in a package 200.

Although certain specific exemplary embodiments are described above in order to illustrate the invention, the invention is not limited to the specific embodiments. For example, although the magnetic card holder uses magnets as a retaining means, in other embodiments, other retaining means are employed. For example, the above described magnets or hooks and hook receivers may be substituted by Velcro material. For example, the deck protector sleeve 12 may have Velcro material to attach to the Velcro on the slabs 16. Furthermore, the card holder 11 may be held in the open and closed configuration with Velcro. Accordingly, various modifications, adaptations, and combinations of various features of the described embodiments can be practiced without departing from the scope of the invention as set forth in the claims.

What is claimed is:

1. An assembly comprising: a main unit, wherein the main unit includes at least one guide; a plurality of card holder slabs, wherein card holder slabs are connectable to the main unit in an open configuration or a closed configuration, wherein each of the card holder slabs includes at least one magnet, at least one hook, and at least one hook receiver, wherein the at least one hook and the at least one hook receiver of each card holder slab are configured to connect the card holder slabs to each other; wherein in the closed configuration the card holder slabs are not attached to each other and stacked within the main unit, and wherein at least one hook of the plurality of card holder slabs slides along at least one guide of the main unit in the closed configuration; a plurality of magnetic receptive inserts; and a plurality of deck protector sleeves, wherein each of the deck protector sleeves is adapted to receive at least one playing card and at least one of the magnetic receptive inserts.

2. The assembly of claim 1, wherein when a playing card and one of the magnetic receptive inserts are disposed within one of the deck protector sleeves, the deck protector sleeve is magnetically attachable to the card holder slabs.

3. The assembly of claim 1, wherein the plurality card holder slabs comprises three card holder slabs, and wherein each of the card holder slabs has at least one magnet embedded along an upper surface.

4. The assembly of claim 1, wherein in the open configuration, the main unit is connected to a first card holder slab and the first card holder slab is connected to a second card holder slab.

5. The assembly of claim 4, the main unit, the first card holder slab, and the second card holder slab attach along horizontal surfaces.

6. The assembly in claim 1, wherein the magnets of each card holder slab and the magnetic receptive inserts are made from Neodymium Iron Boron.

7. The assembly of claim 1, wherein an upper surface of the plurality of card holder slabs is covered with a UV coated art work.

8. A method comprising: (a) providing a magnetic card holder assembly to a card playing entity, wherein the magnetic card holder assembly includes a main unit, a plurality of card holder slabs, a plurality of deck protector sleeves, and a plurality of magnetic receptive inserts, wherein the magnetic card holder assembly has an open configuration and a closed configuration, wherein the main unit includes at least one guide, wherein each of the card holder slabs includes at least one magnet, at least one hook, and at least one hook receiver, wherein in the closed configuration the card holder slabs are not attached to each other and stacked within the main unit, and wherein at least one hook of the plurality of card holder slabs slides along at least one guide of the main unit in the closed configuration, wherein the at least one hook and the at least one hook receiver of each card holder slab connect the card holder slabs to each other; and wherein each of the deck protector sleeves is adapted to receive at least one playing card and at least one of the magnetic receptive inserts.

9. The method of claim 8, further comprising:

(b) instructing the card playing entity of (a): to configure the magnetic card holder assembly in the open configuration, to place a playing card and one of the magnetic receptive inserts into one of the deck protector sleeves, and to magnetically attach the deck protector sleeve having the playing card and the magnetic receptive insert onto one of the card holder slabs.

10. The method of claim 8, wherein the magnetic card holder assembly comprises three card holder slabs.

11. The method of claim 8, wherein each of the card holder slabs has at least one magnet embedded along an upper surface.

12. The method of claim 8, wherein in the open configuration, the main unit is connected to a first card holder slab and the first card holder slab is connected to a second card holder slab.

13. The method of claim 12, the main unit, the first card holder slab, and the second card holder slab attach along horizontal surfaces.

14. The method of claim 8, wherein the magnets of each card holder slab and the magnetic receptive inserts are made from Neodymium Iron Boron.

15. The method of claim 8, wherein an upper surface of the plurality of card holder slabs is provided with a visual design.

16. An assembly comprising: a main unit that retains a plurality of card holder slabs in a closed configuration or an open configuration, wherein the main unit includes at least one guide wherein each of the card holder slabs includes at least one magnet, at least one hook, and at least one hook receiver, wherein in the closed configuration the card holder slabs are not attached to each other and stacked within the main unit, and wherein at least one hook of the plurality of card holder slabs slides along at least one guide of the main unit in the closed configuration; wherein the at least one hook and the at least one hook receiver of each card holder slab are configured to connect the card holder slabs to each other; and means for removably attaching a playing card to at least one of the card holder slabs.

17. The assembly of claim 16, wherein the means is a magnetic receptive insert and a deck protector sleeve, wherein when the magnetic receptive insert and a playing card are disposed within the deck protector sleeve, the deck protector sleeve having the playing card and the magnetic receptive insert is removably attached to at least one of the card holder slabs.

* * * * *